US005592052A

United States Patent [19]

Maya et al.

[11] Patent Number: 5,592,052

[45] Date of Patent: Jan. 7, 1997

[54] VARIABLE COLOR TEMPERATURE FLUORESCENT LAMP

[75] Inventors: Jakob Maya, Brookline; Jagannathan Ravi, Bedford, both of Mass.

[73] Assignee: Matsushita Electric Works R&D Laboratory, Woburn, Mass.

[21] Appl. No.: 490,078

[22] Filed: Jun. 13, 1995

[51] Int. Cl.[6] ..... G05F 1/00

[52] U.S. Cl. ..... 315/291; 315/248; 315/237; 315/302; 313/485; 313/635; 313/643; 313/506; 313/572; 313/493

[58] Field of Search ..... 315/291, 248, 315/105, 107, 230, 237, 300, 302; 313/458, 485, 487, 493, 494, 498, 506, 572, 635, 643

[56] References Cited

U.S. PATENT DOCUMENTS

| | | | |
|---|---|---|---|
| 4,075,532 | 2/1978 | Piper et al. | 313/497 |
| 4,079,287 | 3/1978 | Soules et al. | 313/487 |
| 4,088,923 | 5/1978 | Manders | 313/487 |
| 4,107,571 | 8/1978 | Tanimizu et al. | 313/486 |
| 4,128,789 | 12/1978 | Owen | 315/209 R |
| 4,137,484 | 1/1979 | Osteen | 315/209 R |
| 4,176,294 | 11/1979 | Thornton, Jr. | 313/485 |
| 4,357,559 | 11/1982 | Piper | 315/248 |
| 4,891,550 | 1/1990 | Northrop | 313/487 |
| 5,363,019 | 11/1994 | Itatani et al. | 315/169.1 |

OTHER PUBLICATIONS

Polman, J. van der Werf and Drop, P. C., "Non–linear effects in the positive column of a strongly modulated mercury–rare gas discharge", J. Phys. D. Applied Phys. 5 (1972), p. 266.

Barnes, B. T., "The dynamic characteristics of a low pressure discharge", Phys. Rev. 86 (1952), p. 352.

M. Aono, M. Jino, M. Kubo, R. Itatani, "Color control of fluorescent lamps", The 7th International Symp. on the Science & Technology of Light Sources, Kyoto, Japan, Aug. 1995.

S. Tanimizu and A. Kougami, "Design considerations for color temperature variable fluorescent lamps", The 7th International Sump. on the Science & Technology of Light Sources, Kyoto, Japan, Aug. 1995.

*Primary Examiner*—Robert Pascal
*Assistant Examiner*—Haissa Philogene
*Attorney, Agent, or Firm*—Jerry Chohen; Edwin H. Paul; Stephen Y. Chow

[57] ABSTRACT

A fluorescent lamp (2) having at least two phosphor coatings (12) on the surface of the sealed lamp bulb, typically an inner surface. There is variable driving means which preferentially activates one phosphor and not the other phosphors, at one arrangement or setting or configuration of the driving means, while at another setting the driving means activates in addition a different or several different phosphors. Each phosphors may be a blend of phosphors and the phosphors and/or blends may be overcoated upon one another forming multiple layers or all mixed together and applied as a one layer coating on the lamp surface. The inventive lamp uses standard fabricating techniques and materials, but allows the user to change the color temperature of the lamp by controlling parameters of the electrical driving signal, that is the, spectrum and quantity of light emitted are changed in response to the changed driving signal such that the user can arrange the light output to be more or less blue or red or to balance the longer wavelengths perceived against the shorter wavelengths perceived.

17 Claims, 7 Drawing Sheets

VARIABLE COLOR TEMPERATURE FLUORESCENT LAMP

FIELD OF THE INVENTION

This invention relates to a discharge, or fluorescent, lamps, and more particularly to discharge lamps where the color of the light emitted can be controlled

BACKGROUND OF THE INVENTION

As is well known in the art, fluorescent lamps come in all sorts of different tones or colors of white. Even though they all appear to be white, their color temperature varies anywhere from 2500 to about 6000 or even 8000 and 10,000 Kelvin (herein defined as degrees Kelvin). Herein "color temperature" is related to the temperature of black body which would give an equivalent tone of white light. In general, the lower the color temperature the redder the tone of the white light, and conversely the higher the color temperature the bluer the tone of the white light. There is no specific component in the lamps having a temperature equal to the color temperature—the term is a standard used in the industry to compare the color of various fluorescent (and for that matter incandescent) lamps. The drive for different colors of fluorescent lamps derives from our familiarity with the redder, warmer incandescent lamps and our desire to have the more efficient fluorescent lamps mimic this warmer light in certain instances. This is due to the fact that the market requirements differ greatly as to the degree of whiteness that is required for different situations. For example, offices use mostly high color temperature fluorescent lamps somewhere in the vicinity of 4100 or even 5000 Kelvin. Part of the reason for the higher color temperature requirements is that these lights tend to be somewhat closer to sunlight and therefore they induce alertness and crisp daylight ambiance or atmosphere. On the other hand, in applications where somewhat softer moods or after work atmosphere is more appropriate the color temperature of the light source is typically reduced to about 2500, 2700, or 3000 Kelvin. Those lamps tend to give a light color which is somewhat closer to sunset or dusk or to incandescent lamps that people are used to at home.

Discharge lamps with different color temperatures are obtained by blending different phosphors which under identical ultraviolet excitation give somewhat different colors. Therefore, a discharge lamp must be replaced by a lamp with a different phosphor blend to produce a different color light. The color of that lamp is fixed and determined by the choice of the phosphors, and that is the reason different color temperature lamps are on the market in separate bulbs.

Generally speaking, 80% or so of the sales of discharge lamps is for lamps with color temperature range from about 3000 to 5000 Kelvin. This 2000 Kelvin range provides a quite perceptible range of different colors. However, there are some sales for lamps with a color temperatures below 3000 Kelvin, and some sales for lamps with color temperatures well above 5000 Kelvin.

Typically, residential applications tend to prefer the lower color temperature fluorescent lamps either in the circleline or in the compact fluorescent configuration. The compact fluorescent lamps (CFL) that penetrate the residential market have color temperature in the 2700 to 3100 Kelvin range which gives a reddish quality to the white light. The content of red in these residential lamps is higher than the lamps found in offices or other such business applications. In the residential market of today, the available varieties of colors is acceptable, in fact, it is preferable. It is an object of the present invention to provide a color variable CFL for use in the kitchen area, the hall area, or in the rooms where lights stay on for a long period of time. In such settings, the residential customer is provided with the desirable (and marketable) advantage of changing the color of the light without replacing the bulb to provide different moods during the course of the day and over different seasons.

Prior attempts to make a variable color temperature fluorescent lamp have, for one reason or another, never been commercialized. In many of these cases the structures of these ideas are not practical, economical, or not amenable to efficient manufacturing. The remaining cases have other performance limitations which preclude commercial success. For example, it is well known in the art of fluorescent lamps that if one increases the temperature of the lamp the amount of mercury, which is in the vapor phase, increases substantially producing more of the blue mercury lines which increases the color temperature, and so the light appears more bluish. This does change the color of the light; however the life of the lamp is markedly reduced, and the additional energy supplied (to raise the temperature of the mercury) reduces efficiency (defined herein as the ratio of the light intensity emanating from the lamp compared to the electrical power supplied to the lamp).

Another attempt to provide variable color light from discharge lamps has been to use multiple lamps of different color temperatures side by side and/or mixed in a fixture. In order to use such a fixture, one lamp of one color temperature is fully energized and the other is not fully energized. By changing the power distribution between the two lamps, e.g. a low temperature (reddish) and a high temperature (bluish) lamp, it is possible to make the fixture emit light of different colors. This is a brute force approach whereby the lamps are not deployed at their full efficiency. Both lamp life and the efficiency are reduced when lamps are operated in this mode. Furthermore, one would need to sell a whole fixture with a variety of lamps in order for this variable color to be deployed. Another disadvantage of this approach is that one end of the fixture emanates a different color than the other end of the fixture due to the physical position of the two lamps in the fixture. Also, since one lamp is not fully energized one end of the fixture is brighter than the other end in addition to the color difference. This approach, from an aesthetic point of view, is not an acceptable solution and it has not resulted in a successful product.

Another device that provides variable color light from discharge devices is shown in U.S. Pat. No. 5,363,019, entitled, VARIABLE COLOR DISCHARGE DEVICE, to Itatani et al., and assigned to Research Institute for Applied Sciences, of Kyoto Japan. This patent issued on Nov. 8, 1994. This inventive device used a mixture of two gases that, when excited, provide different color discharge light. The gases are controlled by electric fields.

It is an object of the present invention to overcome this limitation by providing a single variable color temperature lamp having a coating of a fixed blend phosphor or layers of such coatings on the lamp bulb. A related object is to provide a lamp with multiple coatings of different phosphors or combinations of phosphors or blends of such phosphors.

It is an object of the present invention to provide a lamp where the color can be changed without substantial loss of efficiency and/or life and to provide a practical system that can be manufactured with existing technology.

It is yet another object of the present invention to provide a variable color fluorescent lamp with a variable color temperature that extends from at least 3000 to 5000 Kelvin. A related object is to provide variable color temperature fluorescent lamps wherein each lamp may have a variable color temperatures range a few hundred to several thousand degrees Kelvin.

SUMMARY OF THE INVENTION

The preceding objects are met by a variable color temperature regular or compact fluorescent lamp. A variable color lamp is defined herein as a fluorescent lamp whose color temperature can be controlled at will by externally varying a parameter of the electrical driving signal to the lamp such as: current, voltage, the frequency of the signals, use of intermittent signals or signals with pulse segments, where the type of pulse segment, is described by characteristics such as rise times, fall times, amplitudes, electrical signal waveform shapes and the like. The variations of the drive signal cause the spectral emissions from the mercury to have corresponding different amounts of energy in the various spectral lines. By coating the lamp bulb with phosphor blends or layers that preferentially react to the different spectral lines a mechanism is created that allows changes in the external electrical drive signal to result in different colors of light emitted from the lamp. The invention applies to all known fluorescent lamps, of any shape, size, power, and configuration. Furthermore, an advantage of the present invention is that the variable color lamp can be made with existing technology.

Herein, type A is used therein to specify, generally, those materials which absorb and respond to a range of incident radiation around 254 nm, and type B to materials that have reduced absorption and response to the 254 nm range of type A, but do respond to other radiation wavelengths, e.g. 365 nm and/or 185 nm. However, the use of type A and/or type B and/or type C herein are simply to designate separate phosphors or blends. No limitation is suggested as to use of type A, B or C, herein. Many different phosphors and blends of phosphors can be used to advantage within the scope of this invention, all that is required of the different phosphors and blends thereof is that they can be mixed or overcoated upon one another, and where each has a different absorption spectrum and emission spectrum compared to any other.

The objects are met in a discharge lamp including a chamber (or bulb) with transparent walls, said chamber sealed to the atmosphere, a mixture of a rare gas, e.g. krypton, argon, or substantially any of the noble inert gases, and mercury contained within the chamber, a first phosphor or phosphor blend (type A) covering a first portion of the chamber wall, a second phosphor or phosphor blend (type B) covering a second portion of the chamber wall, and where said first and second portions may overlap and range independently from a small area of said inner chamber wall to substantially the entire chamber wall, two electrodes extending into the chamber through said walls with external electrical contacts, means to drive an electrical signal from one contact through the chamber to the second contact, and means to control the electrical signal such that the phosphors are preferentially excited such that the phosphors will produce different wavelengths and quantity proportions of visible light. In other preferred embodiments a third phosphor or phosphor blend, covering a third portion of the chamber wall is implemented in addition to the first two, and where the portion of the chamber wall may overlap and range independently from a small area to substantially the entire area. In yet other preferred embodiments additional phosphors or phosphor blends may be used.

There are no variable color temperature fluorescent lamps on the market—likely due to the technological and cost challenges involved in making such a lamp. The present invention provides substantial advantages over currently existing products. These advantages are:

1. Customers would have access to a variety of color temperatures in one lamp that they can alter at will depending on their needs, application, time of day, and season. This advantage is likely to command a substantial premium over existing products in the marketplace. Furthermore, customers will be able to create special effects by emphasizing certain color temperatures in one part of the space and other color temperatures in other parts.
2. From the manufacturing and distribution point of view, the costs of supplying one lamp rather than the eight or ten different color temperature lamps now being supplied will reduce costs that will result in a lower price to the customer.
3. Manufacturing costs associated with making variable color temperature lamps are likely to be significantly less. This is due to the fact that every time there is a changeover for making the same lamp in a different color temperature one loses labor time, machine time, and materials such as phosphor and glass scrap. Overall shrinkage, that is lamps and components that are scrapped due to poor quality, during the transition is likely to drop significantly. It is self evident that making a single type and a single color lamp (or two or three different lamps) is easier and cheaper than making a multiplicity of color temperature lamps. Therefore, everything else being equal, a single phosphor system lamp is cheaper to make.
4. Components costs are likely to drop. Purchasing and blending eight to 10 or more different phosphors each at different quantities is more expensive than purchasing and blending only two or three phosphors, each at proportionally higher quantities to make the same number of lamps. This increase in quantity typically translates to lower price. Therefore, savings should be realized due to this scale up in purchased components.

Other objects, features and advantages will be apparent from the following detailed description of preferred embodiments thereof taken in conjunction with the accompanying drawings in which:

DESCRIPTION OF THE PREFERRED EMBODIMENTS

Figure 1:
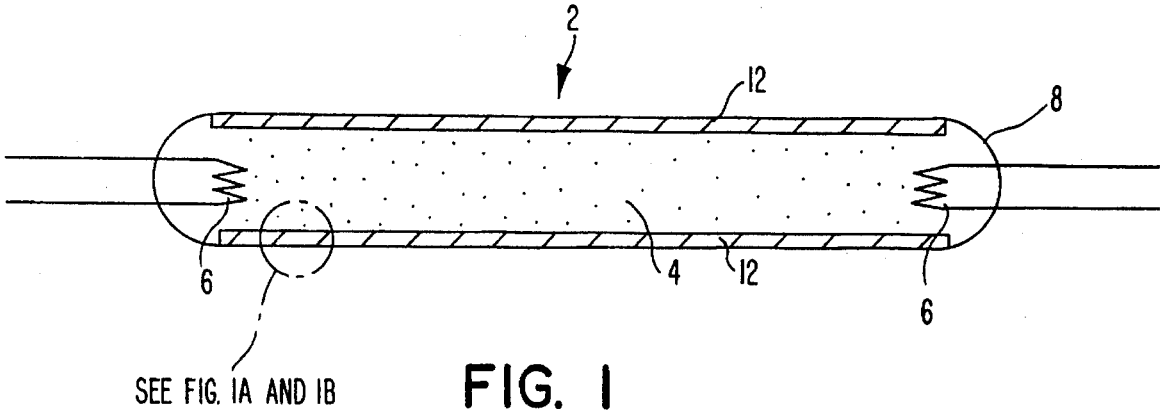
FIG. 1 is a schematic of a fluorescent or discharge lamp according to a first preferred embodiment.
Figure 1A:
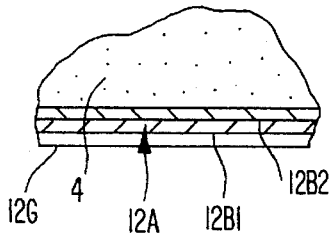
FIGS. 1A and 1B show a portion of the coated wall section of the FIG. 1 devices (at A/B) and illustrate two variant embodiments wherein a two phosphor layer coating (FIG. 1A) and a three phosphor layer coating (FIG. 1B) are provided in contrast to a single coating of blending phosphors in FIG. 1.
Figure 1B:
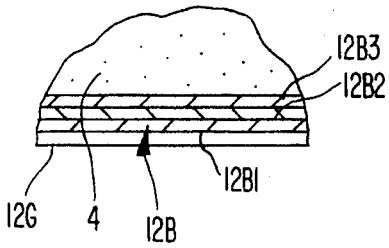

FIGS. 1, 1A, 1B show the fundamental elements of a discharge lamp 2. As is well known, a low pressure mercury/rare gas 4 discharge constitutes the heart of a fluorescent lamp. Electrodes 6 protrude through the glass envelope 8 and these electrodes are connected to an AC power source, see FIG. 2. An electrical discharge between the two electrodes 6 within the envelope excites the mercury to produce, quite efficiently, 254 nm (nanometer) radiation which is one of the fundamental resonance lines of mercury. The rare gas, typically argon or krypton, is used to prevent the rapid deterioration of the electrodes 6 during operation. This 254 nm radiation impinges upon the walls of the tube which are typically coated 12 with a phosphor material. The phosphor particles absorb the ultraviolet (254 nm) photons and converts them to visible radiation. Depending on the phosphor matrix, as well as the doping concentrations therein, a shade of white or any other color can be generated. Examples of dopants which could be used herein are: Eu, Tb, Ce, Mn, Gd, and the like. As stated above and as appears in more detail hereinafter, the phosphor coating comprises multiple distinct phosphor choices that can be a single layer 12 of blended phosphors as illustrated in FIG. 1, a layered coating arrangement 12A as in FIG. 1A comprising a glass substrate 12G as part of the envelope overlaid with phosphor layers 12A1 and 12A2; or a layered coating arrangement 12B as in FIG. 1B comprising coating layers of phosphors 12B1, 12B2, 12B3 on the envelope wall. Stippling is shown in the envelope in FIGS. 1, 1A, 1B to illustrate the discharge 4 generally.

Green, red, or purple fluorescent light sources for specialized applications have been produced. As mentioned above, the white light could vary anywhere from color temperatures of 2000–2500 Kelvin to about as high as 10,000 Kelvin. This is accomplished by changing the concentrations of the dopants and the proportions of the phosphor blend that produce blue, green and red colors. Again, as mentioned above, once the phosphor is deposited on the surface of the glass and baked, it becomes a permanent part of the lamp and therefore, when operated as in the prior art, the color is fixed. In addition to the above sources of emitted light, often some of the higher energy states of the mercury atoms are excited that emit blue and green colors or lines (line herein is defined as the spectral line associated with electrons falling from higher energy states to lower energy state with a concomitant release of light). These line colors are taken into account to determine the ultimate color of the emitted light from a manufactured lamp.

Figure 2:
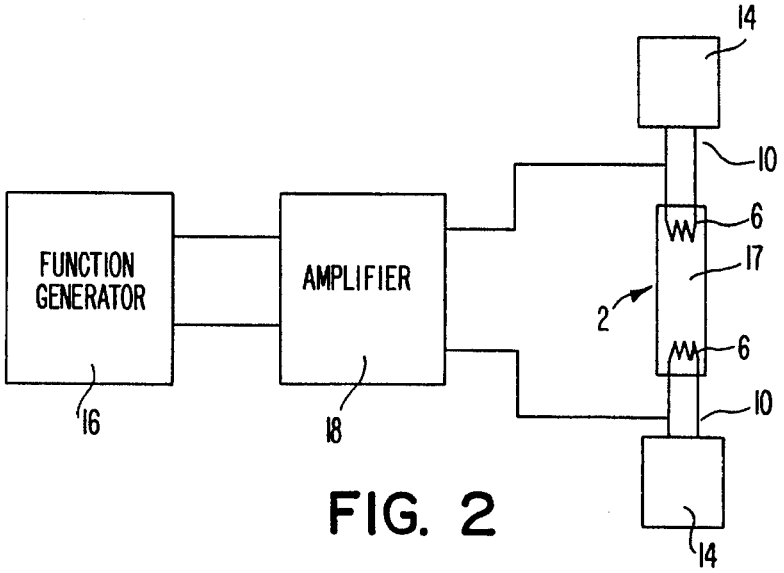
FIG. 2 is a block diagram of the circuitry driving the lamp of FIG. 1.

FIG. 2 shows in block diagram form, an arrangement suitable for powering a discharge lamp used in accordance with the present invention. The electrodes 6 are heated to thermionic emission by the supplies 14 connected to the external portions 10 of the electrodes. The function generator 16 and a power amplifier 18 form a flexible system to produce electrical signals to drive the lamp. These components (16, 18) may be arranged to modify the electrical signals to change the color temperature and so the emitted light of the discharge lamp 17. Once a desired lamp color temperature has been determined an electronic ballast circuit can be synthesized to operate the lamp at that desired color temperature using present technology as in ballasts which control fluorescent lamp operation today.

Other means to produce excited mercury atoms without using electrodes, say by electromagnetic means, may be used to advantage within the scope of this invention.

It is known that the mercury atom can be placed in excited conditions where the atom's electrons have been displaced into higher energy states compared to an unexcited condition of the atom. It is also known that these excited atoms will spontaneously return to their unexcited states and will emit spectral lines that are characteristic of the specific energy states. The mercury spectral lines (in nanometers) having useful intensities and of interest are: 185, 254, 365, 407, 435 and 546. It has been discovered that by changing the driving scheme of the lamp, that is the way the discharge lamp is powered, that the proportional intensity of light emitted among these spectral lines can be changed. There is a relationship between the way the lamp is driven and the intensity of light generated in these spectral lines.

Figure 3A:
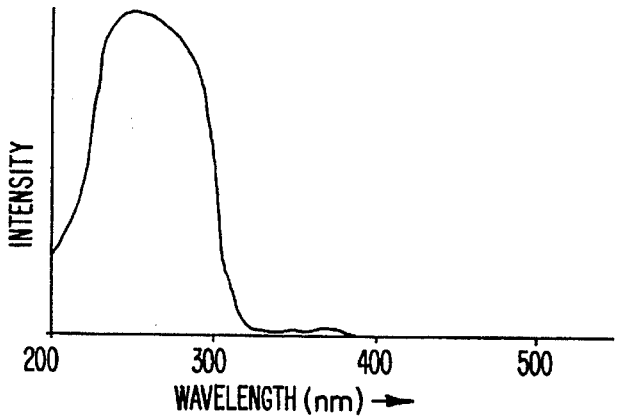
FIG. 3A and 3B are excitation spectra for some type A phosphors.
Figure 3B:
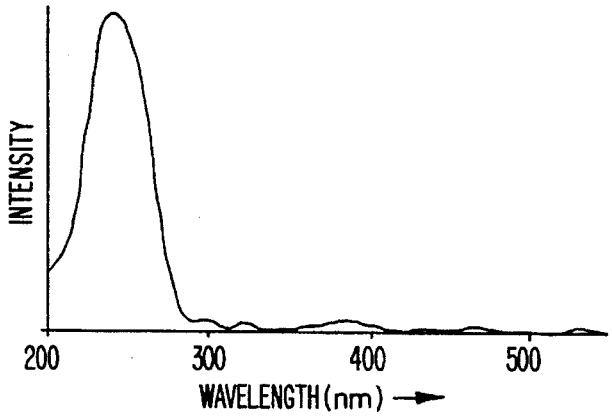
Figure 5A:
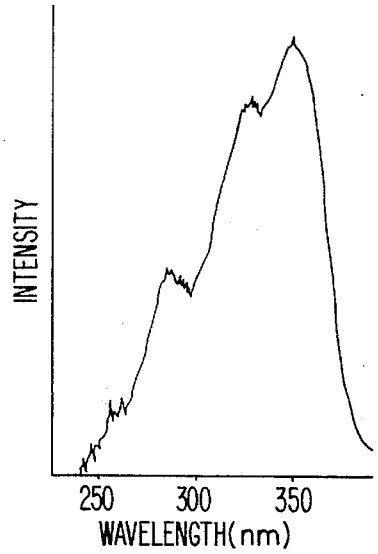
FIG. 5A is the excitation spectrum for a type B phosphor.
Figure 5B:
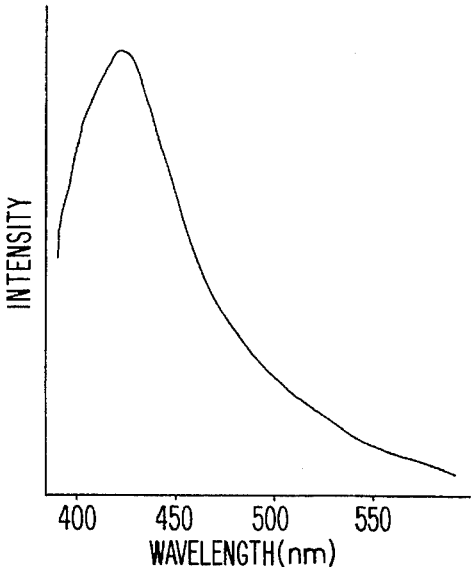
FIG. 5B is the emission spectrum of the type B phosphor of FIG. 5A.

In order to use the above discovery to advantage, phosphors were obtained that respond preferentially to the various spectral lines and to produce different color temperatures and so different emitted light color. The scheme works as follows (using the mercury lines as the phosphor excitation radiation): FIG. 3A and 3B shows the excitation spectrum of typical phosphors used in fluorescent lamps. NP 92 is a blend of NP220 shown in FIG. 3A and NP340 shown in FIG. 3B. NP refers to phosphors produced by the Nichia Co. of Japan. Both of these phosphors respond substantially to the 254 mercury spectral line, and both output significant light intensity around 611 nm and 544 nm. Another phosphor, e.g.(Y,Ba)2SiO5:Ce (refered to herein as YBA), produced by the Nemoto Phosphor Co. of Japan, has a reduced excitation response to the 254 nanometer mercury resonance line but is substantially excited by the 365 nanometer radiation was developed. The excitation curve of this phosphor is shown in FIG. 5A, and the corresponding emission spectrum is shown in FIG. 5B. From inspection of these curves it can be seen that this phosphor responds significantly to the 365 nm but insignificantly to 254 nm, and this phosphor outputs light around 420 nm. When two phosphors are blended, one which is excitable primarily by the 254 nm and the other by the 365 nm mercury line, and if each of these phosphors are preferentially excited in a controlled manner that the color of the emitted output light from these phosphors can be controlled. YBA is not the only phosphor of type B that can be used. Other phosphors include ZnS:Ag, ZnS:Cu, $BaAl_{12}O_{19}$:Mn, and similar phosphors.

Figure 3C:
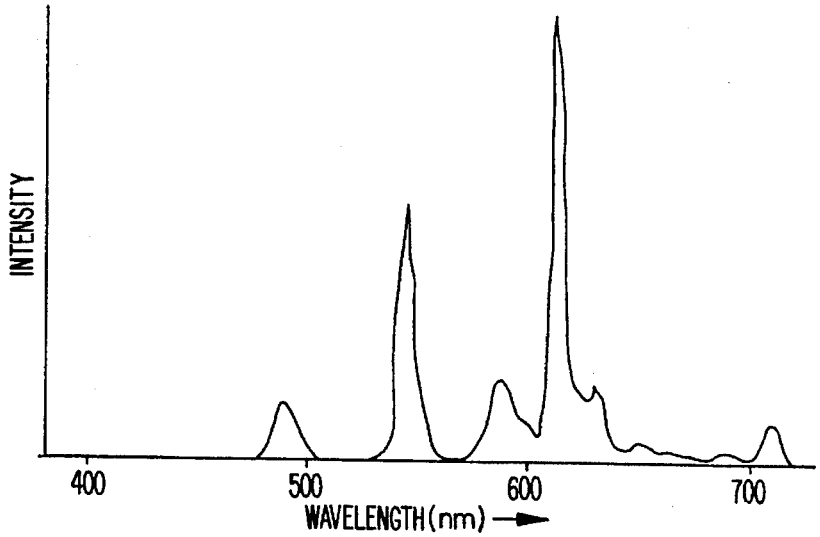
FIG. 3C is the corresponding emission spectrum of the type A phosphors of FIGS. 3A and 3B.

In prior art, normal conditions of operation are where the mercury emits primarily 254 nm, only phosphor emissions as in FIG. 3C would be useful (type A). Typically about 90% of the radiation which is emitted by mercury is in the 254 line under AC or DC normal, continuous wave operation. Therefore, as a result of this normal operation only phosphor type A is excitable producing the regular white light which is the basis of the fluorescent lamp. Now if the excitation mode is changed to a pulse scheme or a number of other such schemes which will be described later on the mercury 365 line can be increased to a higher percentage. For example, under prior art normal conditions only 2% of the total radiation is in the 365 line, but by pulsing or burst pulsing the driving electrical signal into the lamp the 365 line radiation can be increased to about 10% of the total emitted radiation. Now the second phosphor type B is excitable, and the radiation of the second phosphor (type B) is added to the radiation of phosphor type A. This, in many cases, is sufficient to change the color temperature of the lamp enough to satisfy most user's needs. Furthermore, by changing the frequency and the excitation mode of the driving electrical signal the amount of 365 nm radiation produced can be varied from 2% to 10% on a continuous basis depending on the amount of power that is introduced. The phosphor blend can be selected with reasonable efficiencies that provide a color change especially in the 3000 to 5000 K. range. A preferred embodiment includes phosphors selected from Sr5(PO4)3Cl:Eu, (Y,Ba)2SiO5:Ce, LaPO4:Ce,Tb, and Y2O3:Eu.

If the majority of the radiation is obtained from the 254 nm via the first phosphor type A, which has a high efficiency then the loss of efficiency in the lamp as a result of changing the excitation scheme (to obtain color change) is relatively minimal. This is true because up to ninety percent of the light intensity still comes from the 254 nm radiation. This embodiment results in use of an ordinary, prior art, regular lamp with a fixed phosphor blend which under certain excitation schemes emits light of one color temperature and, as the excitation scheme is altered, it emits light of a different color temperature. The advantages in this approach are that: the lamp is manufacturable, using existing technology, therefore it is relatively low cost; only the driving scheme needs to be re-configured probably using an electronic circuit excitation; and for color temperature changes within the limits of market requirements there is no substantial loss of efficacy. These features and advantages make the present invention very attractive and practical.

In one preferred embodiment the phosphors are blended, but in another preferred embodiment the phosphors are applied as separate layers. Another preferred embodiment is as follows: a layer of ZnS (zinc sulfide) phosphor is first coated on a glass; a layer of NP92 overcoats the first layer (NP92 has green and red rare earth phosphor components). This embodiment resulted in a color temperature change of about 1200° K. between a continuous excitation and a pulse burst excitation. There was a 15% decline in efficacy. ZnS was chosen because of its strong absorption at 365 nm and weak absorption at 254 nm. A third embodiment includes the additional third layer overcoating the two layer mentioned just above. This third layer was YBA which was added to absorb the 185 nm radiation (not shown in the drawings). This third embodiment also provided a substantial color temperature change. Within the scope of this invention there are numerous combinations of phosphors and blends thereof that exploit the extra ultraviolet radiation emitted under the pulse drive electrical signals described herein. In addition, additional layers beyond three can be used to advantage within the scope of the present invention.

An important aspect of this invention is that, when color change of the emitted light from a lamp is desired, the present invention generates proportionally more 365 nm radiation compared to 254 nm radiation. For example, the 365 nm radiation intensity can rise five-fold from two to ten percent, while the 254 nm radiation may change by only a few percent.

The mercury 254 nm radiation line (line refers to radiation or light emanating at a fixed frequency) originates at the lowest excited state above the ground state at an energy level of 4.86 eV. In order to generate the 365 nm line, an energy level of nearly 9 eV has to be attained. By using a pulse or pulse burst drive, more mercury atoms can be excited to the higher energy levels required for the increased 365 nm radiation production and the corresponding color temperature change described in this invention. Within a drive scheme employing pulses, there are many ways to shape the pulses or the burst of pulses. Some of these schemes are more efficient and/or practical for the production of non 254 nm mercury lines than the others as described later.

Figure 4A:
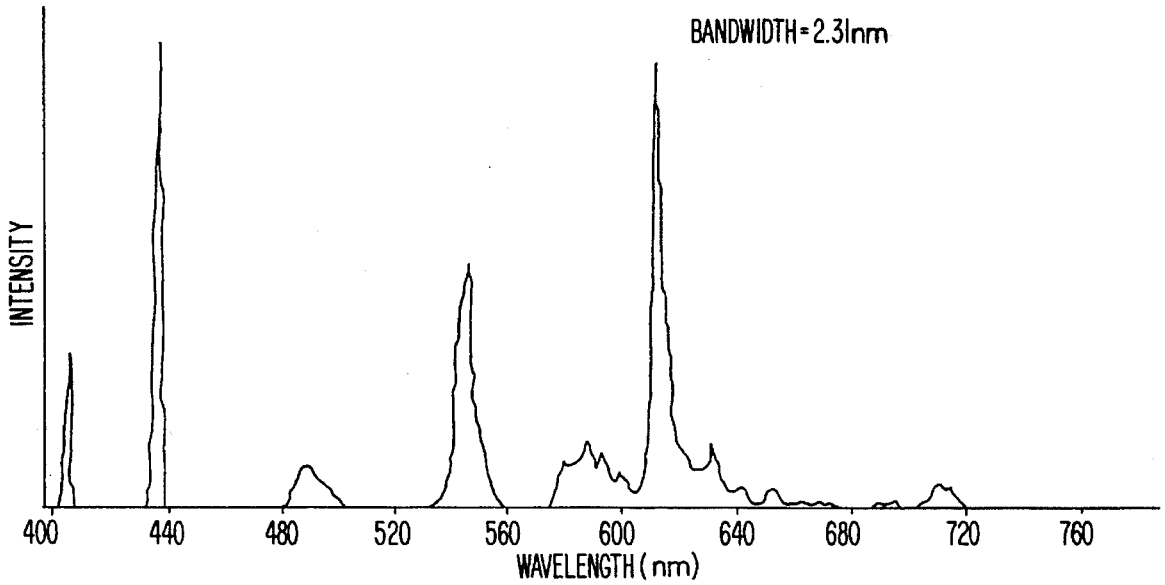
FIG. 4A is the emission spectrum for a lamp with type A phosphor including the blue spectral emission lines from mercury.
Figure 4B:
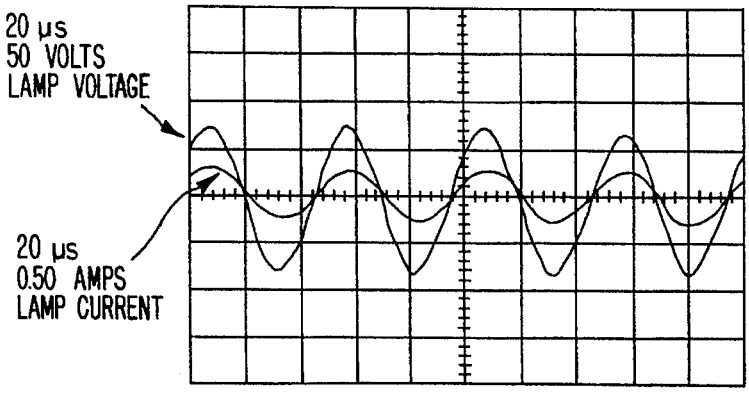
FIG. 4B is the drive waveform used to produce FIG. 4A spectrum.

FIG. 3A, 3B and 3C show the normal, prior art phosphor type A excitation and emission spectra which is used in most fluorescent lamps. This phosphor is called a rare earth tri-phosphor. FIG. 4A shows the normal mercury/noble gas emission spectra whereby a majority of the emissions is due to the type A phosphor conversion of 254 nm radiation. FIG. 4B shows the electrical driver voltage and current waveforms used to generate the emission of the lines of FIG. 4A. The driver waveforms shown are similar to those obtained from a commercial electronic ballast. The parameters of the electrical waveform in FIG. 4B are 20 kHz at eight watts.

FIG. 5A shows the new phosphor which has been used in an embodiment of the present invention. This is a commercially available phosphor obtained from Nemoto Phosphor Company which is presently used in a variety of non-lamp applications. However this phosphor is compatible with the lamp environment, and this phosphor is typically tailored to respond to 365 nm excitation. FIG. 5B shows the emission spectrum of the phosphor which is in the blue visible region. Other phosphors, excitable by 365 nm excitation, are available that emit visible light in the green, red or some other part of the spectrum. For example the phosphor ZnS:Cu,Al (zinc sulfide, copper aluminum) emits green, YVO4:Eu (yttrium vanadate europium) emits red, and ZnS:Ag,Cl (zinc sulfide, silver chlorine) emits blue. Finally, combinations of these foregoing phosphors will emit light combination to achieve a variety of colors. In addition, there are many other phosphors, known in the art, that one could employ within the scope of this invention to maximize the absorption of 365 nm excitation and emit visible light. See *FLUORESCENT LAMP PHOSPHORS,* by Keith H. Butler, published by Pennsylvania State Univ. Press, 1980.

Figure 6A:
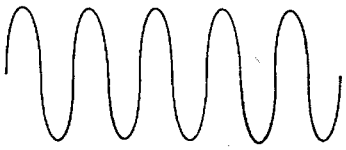
FIG. 6A–6H are some electrical drive waveforms used to drive the fluorescent lamps.
Figure 6B:
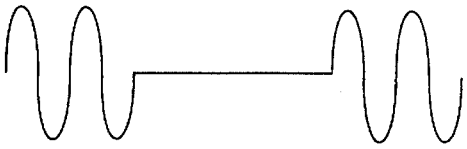
Figure 6C:
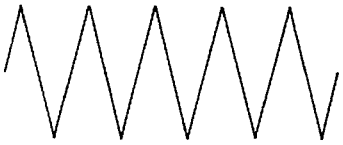
Figure 6D:
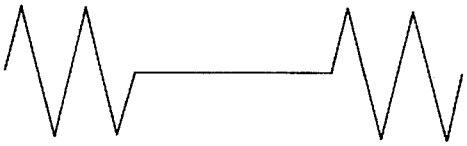
Figure 6E:
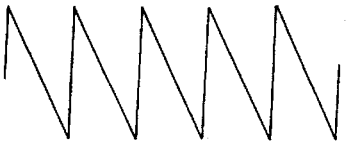

Finally, FIGS. 6A–H shows some examples of pulse burst excitation waveform signals used to drive the lamp that augment 365 nm emission of a mercury/rare gas discharge. Herein, pulse burst is defined to include a range of pulses from a single pulse to a multitude of pulses. Rounded or sinusoidal waveshapes are found in the forms of FIGS. 6A and 6B. A pulse segment is herein defined as a single pulse starting at the base line and ending when the base line is encountered twice more. Rise times are accentuated in triangular shapes or forms of FIG. 6E and F, and rise and fall times are accentuated in the rectangular or square shapes of FIG. 6G and 6H. FIGS. 6B, D, F, and H exhibit pulse burst or intermittent waveform signals. Intermittent waveform is herein defined as a waveform comprising a series of pulse burst separated from each other. A preferred embodiment of the present invention uses combinations of these drive signals where the intermittent signals are substituted for the continuous waveform signal of FIG. 6A when a color temperature change is desired. In fact combinations of the various continuous signals and the pulse or intermittent signals can be used within the scope of the present invention. For example, one combination may be a continuous waveform, used for given color temperature, with a change to a drive waveform comprising a pulse or intermittent waveform superimposed on the continuous waveform which yields a changed color temperature. Other combination includes a change from a given continuous waverform to an waveform comprising alternating periods of two other different waveforms. In fact any combination of separate pulse waveforms and composites of different pulse burst waveforms, including periods of no drive signal interspersed among the pulse waveforms, can be used to advantage in the present invention.

In another preferred embodiment a fluorescent lamp made in accordance with the present invention may be driven by a low amplitude electrical drive signal that maintains a low level of excitation of the mercury and a corresponding low level of light emitted by the phosphors. This drive signal is described in the art as a "keep alive" or "simmer" signal. Actual power levels in a simmer operation of a lamp range from a few percent upwards to well over ten percent, with ten percent being most common. In this state an intermitent signal may be used such that a low level of light is generated. Typical operation might be to have the simmer signal for 14 ms (milliseconds) followed by a 1 ms pulse burst. One benefit of use of such a signal is to avoid the condition when a lamp is fully off and high voltage is needed to cause the mercury to be excited. This high voltage may have some long term detrimental effects on the electrodes.

Figure 7A:
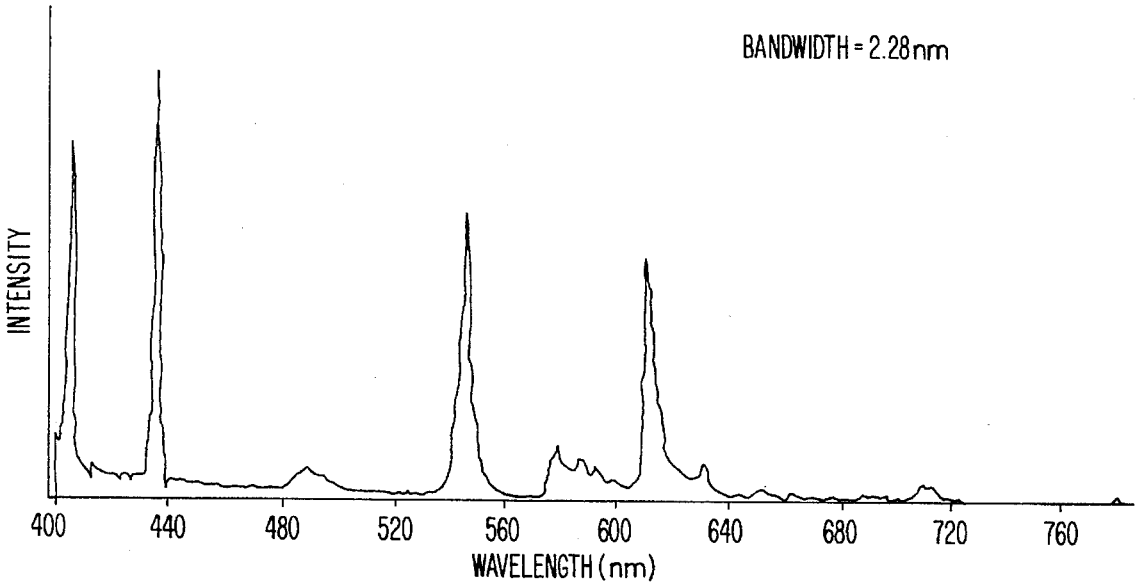
FIG. 7A is the emission spectrum from a lamp with a phosphor blend of 80% type B and 20% type A.
Figure 7B:
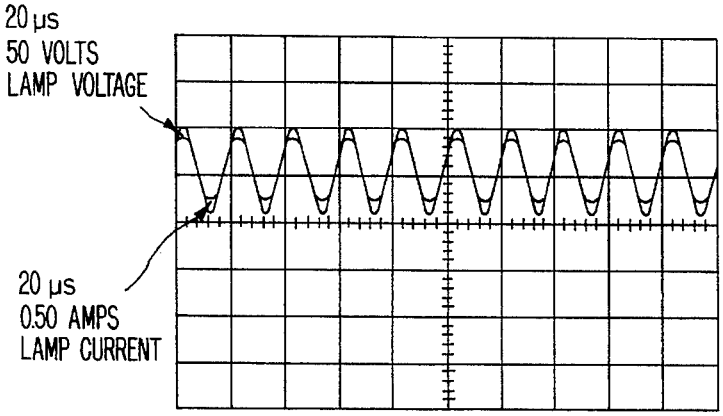
FIG. 7B is the drive waveform to produce the spectrum of FIG. 7A.
Figure 7C:
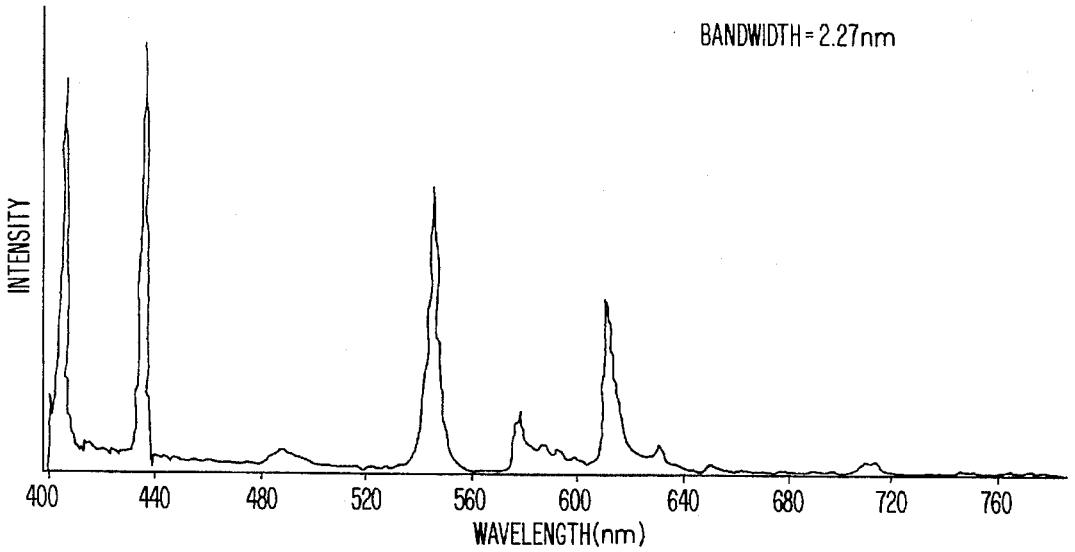
FIG. 7C is the emission spectrum from a lamp with a phosphor blend of 80% type B and 20% type A.
Figure 7D:
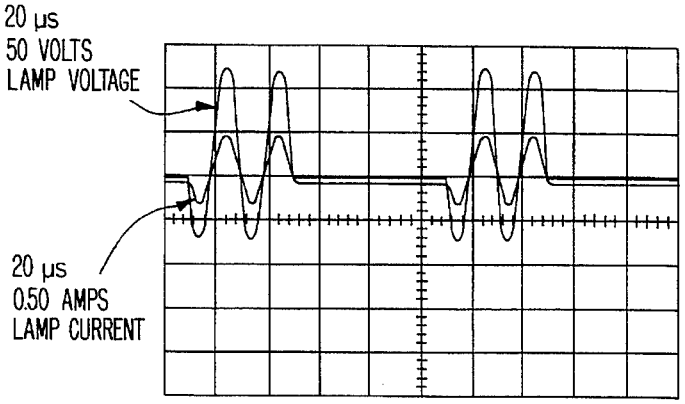
FIG. 7D is the drive waveform to produce the spectrum of FIG. 7C.
Figure 7E:
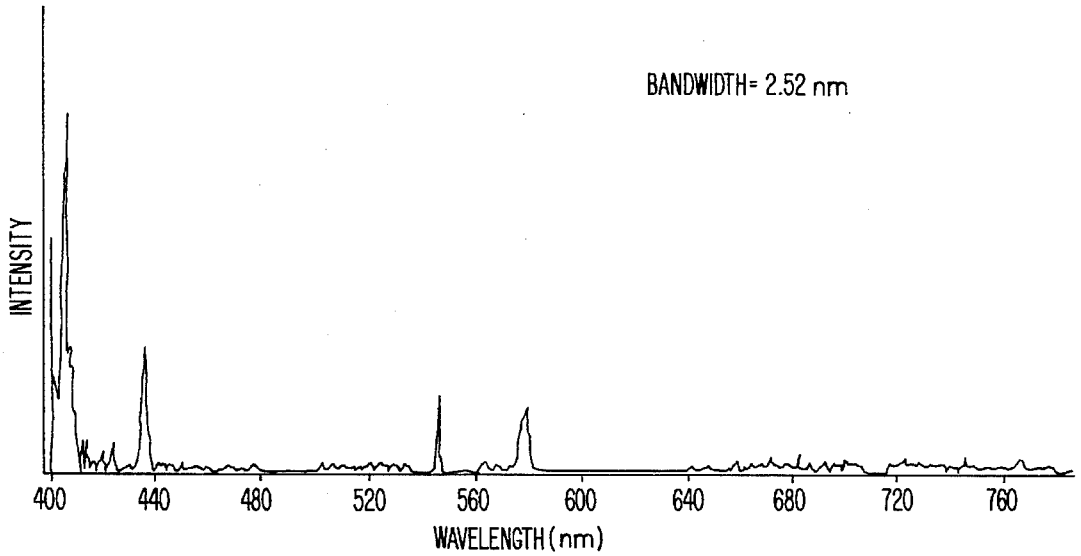
FIG. 7E is the difference spectrum between FIGS. 7C and 7A, showing the emissions added by the pulsed drive of FIG. 7D.

FIG. 7A shows the emission spectrum of a lamp with a blended phosphor which contains about 20% of the type A variety and 80% of the type B variety by volume. FIG. 7B shows the typical, prior art sinusoidal, continuous waveform operation that produces the emission spectrum of FIG. 7A. FIG. 7C shows the emission spectrum under sinusoidal pulse burst scheme excitation shown in FIG. 7D. FIG. 7E shows the difference between the two spectra of FIG. 7C and 7A. FIG. 7E shows a fair amount of blue (in the 400–440 nm range) emission of the phosphor blend and some additional mercury visible lines that have been excited by the pulse excitation. It should be noted that only positive differences, i.e., where the spectral output from pulsing is more than for continuous operation, are shown in FIG. 7E. This lamp was operated at 8 watts.

Figure 6F:
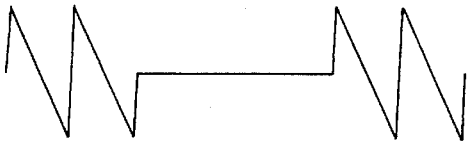
Figure 6G:
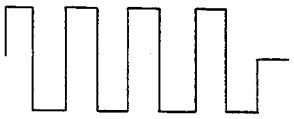
Figure 6H:
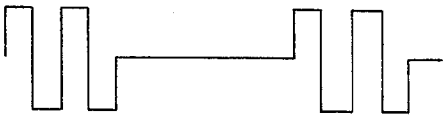
Figure 8:
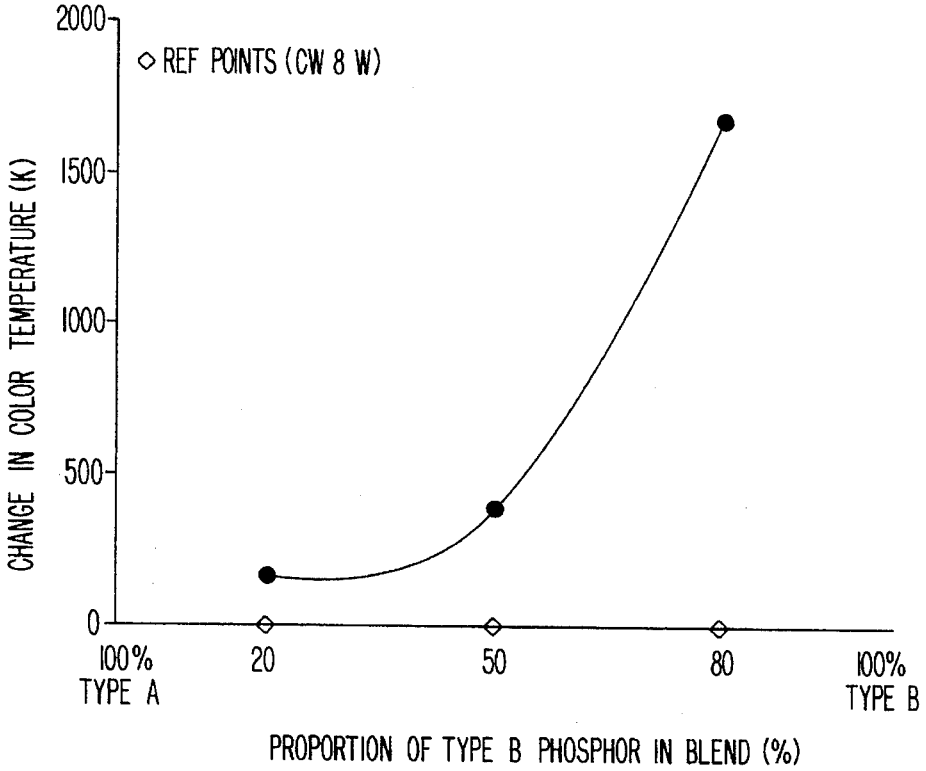
FIG. 8 is a graph of the changes in color temperature against proportions of phosphors of type A to type B, and including differences due to electrical drive waveforms.

FIG. 8 shows the change of color temperature as a function of composition of phosphor type A and phosphor type B. As the phosphor type B percentage composition increases, the color temperature is increased, and the controllable range of color temperatures is larger. The largest color change for a given phosphor blend was obtained when bursts of fast rising triangular pulses were used, these waveforms are shown in FIG. 6F. The change of color temperature shown in FIG. 8 is with respect to symmetrical continuous sine wave of 50 kHz at a lamp power of 8 W. The base line of this graph represents the color with the continuous sinusoidal waveform, where the diamond shaped indicators lie. The lamp was operated at 9 W with the fast rising triangular pulse burst excitation of FIG. 6F, and the resulting color temperature change for each blend is indicated by the dot. As mentioned earlier, any waveform that results in a relative increase of 365 nm, 185 nm and mercury visible lines compared to 254 nm radiation can be used to advantage by the present invention.

Figure 9:
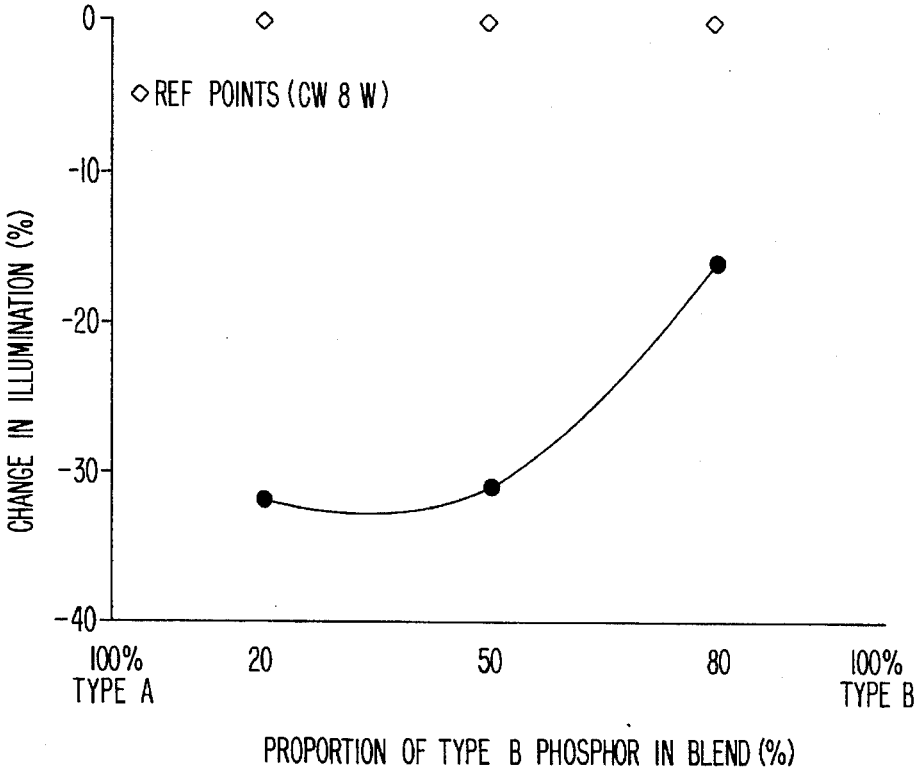
FIG. 9 is a graph of the changes in illumination against proportions of phosphors of type A to type B, and including differences due to electrical drive waveforms.

FIG. 9 shows the change in relative illuminance as a function of percentage composition of type A and B phosphors and under the drive conditions and waveforms as described in FIG. 8. The diamond indicators are along the top axis, zero percent, which is the base line. The changes in illumination due to fast rising triangular pulse burst excitation of FIG. 6F are indicated by the dots.

The techniques of applying the phosphor in layers or in a single layer of a mixture or blend is well known in the art, and such techniques can be used advantageously with the present invention.

EXAMPLE OF A PREFERRED EMBODIMENT LAMP

A tubular FL (fluorescent lamp) was prepared from a glass tube of 0.7" OD and 8" long. The phosphor powders were mixed in a lacquer solution (solvent plus binder) as per standard practice for wet coating applications. Two different phosphor solutions were prepared, as follows

| PHOS-PHOR | MANUFACTURER (designation) | EXCITATION PEAK (nm) | EMISSION PEAK (nm) |
|---|---|---|---|
| TYPE A | NICHIA (NP92) | 254 | 544, 611 |
| TYPE B | NEMOTO (YB-A) | 365 | 420 |

The two phosphor types were then mixed and made into 3 different blends in volumetric ratios for use in fluorescent lamps for generating different colors.

TYPE A: TYPE B
20:80
50:50
80:20

After coating the glass tubes with the phosphor blends, the tubes were dried and baked in an oven to remove the binder and solvent. The electrode glass stem assembly was sealed at each end of the tube. The lamps were then processed by standard techniques to activate the emission material of the electrode coils and then tipped off with a fill of 3 torr of argon as a buffer gas. It can be seen that, except for the special phosphor that is used, capable of selective excitation by 365 nm radiation, the lamp construction and manufacturing techniques are standard industry practices.

For lamp operation, the drive consisted of a Hewlett Packard pulse/function generator (8116A) and a high frequency amplifier (ENI 1040L) connected to the lamp. The electrode heating currents were supplied by separate circuits consisting of a 6 V battery in series with a rheostat and ammeter. The lamp electrical characteristics were measured with a true RMS VAW meter (Yokogawa 2532), oscilloscope (LeCroy 9304M), 100X Tektronix voltage probe and 10:1 current transformer (Pearson 411).

Spectral measurements were done using a Lighting Sciences system which consists of a computer controlled CCD camera that views a diffracted image of the lamp.

The normal operation of the lamp was by driving it with a sinusoidal waveform of frequency 50 kHz. This is equivalent to operating the lamp on a commercial electronic high frequency ballast. The system described above allowed the waveform to be changed to triangular shape and the rise time to be varied. It allowed for continuous (CW) or pulse burst operation. The lamp data includes operation with sinusoidal or triangular waveshapes, continuous or pulse burst operation, rise times normal (i.e., symmetric to fall time) or fast and at slightly different powers.

For the lamp described here, a symmetric, sinusoidal 50 kHz operation at 8 W is described as "normal" operation and is the reference case for the color change experiments.

It should be pointed out that the two phosphors may not necessarily be in very close proximity. For example, one phosphor could be applied to the inside of the arc tube and the second phosphor which is excited by longer wavelength radiation could be applied to the outside of the arc tube. In such a case, there would be a need for another jacket which would protect the second phosphor. Alternatively the second phosphor could be applied to the inside of the outer jacket and the space between the two bulbs could be evacuated. These and many other particular configurations constitute other preferred embodiments of the present invention. The invention as mentioned above includes utilization of two different phosphors which have somewhat different excitation regions and emission regions thereby resulting in a color change upon altered excitation.

It should be noted that mixing more than two phosphor types as well as coating more than two layers of different phosphors types (e.g. three layers, each layer of different absorption and emission spectra) is within the scope of the present invention. A particular embodiment is a three layer configuration of type A responding only to 254 nm, type B responding only to 365 nm, and a type C responding only to 185 nm excitation.

It is important in the present invention to have the electrical drive waveforms to have fast rise time pulses to generate fast electrons. These fast electrons change the prior art electron energy distribution function, and this change results in excitation of the upper energy states of mercury. Excitation of these upper energy states is important in the preferential generation of 185 nm, 365 nm, 546 nm, 437 nm and 404 nm radiation because these particular lines originate from upper excited states of the mercury atom. The literature contains numerous ways of changing the electron energy distribution, see *PROGRESS IN LOW PRESSURE MERCURY-RARE GAS DISCHARGE RESEARCH,* by J. Maya and R. Lagushenko, published in Advances in Atomic, Molecular and Optical Physics. This reference cites several of those techniques. The scope of the present invention includes these approaches as regards to the generation of proportionally higher percentage of upper excited states of the mercury other than the $6^3P$ resonance state which emits the 254 nm radiation. Again, in addition to the phosphors utilized in these experiments, additional phosphors, that are excitable by other wavelengths which result from the pulse excitation or the change in the electron energy distribution function, can be used to advantage in the present invention.

A well known problem of fluorescent lamps concerns electromagnetic interference (EMI) which results whenever a system includes pulses, fast rise time and high frequencies. Usually in such systems there is a certain amount of both radiated and conducted EMI. Both the FCC and the FDA have standards which limit telecommunications interference and health hazards, respectively. These limits are set for industrial, commercial and residential applications of electronic and other equipment, and these standards must be met for a practical, commercial fluorescent lamp.

There are several techniques and technologies that have been utilized in the marketplace to avoid EMI both in the radiated and conducted modes. For the radiated suppression of EMI: grounding the external metallic coverings and screens, covering all openings, together with the use of high permeable materials, such as mu-metal and the like have proved successful in these applications. For the conducted EMI: there are circuits and power line filters that have proved sufficient in the industry to suppress the conducted EMI. Therefore application of these known techniques and materials will be sufficient to reduce the EMI to acceptable ranges.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A discharge lamp comprising:

(a) a sealed chamber with at least one transparent wall, (b) a mixture of rare gas and mercury contained within the chamber, (c) a multi-phosphor coating on said wall comprising (i) a first phosphor covering a first portion of the chamber wall, a second phosphor covering a second portion of the chamber wall, said first and second phosphors having different visible emission spectra, (d) means defining two electrodes extending into the chamber through said walls with external electrical contacts, (e) means for driving an electrical signal from one contact through the chamber to the second contact, where said electrical signal causes the mercury to emit radiation, and where the phosphors absorb said radiation and emit visible light in response thereto, (f) means for controlling the electrical signal such that the phosphors are preferentially excited such that the phosphors emit said different spectra of visible light responsive to said means for controlling, and wherein (g) said means for controlling comprise means for selectively establishing at least two distinct wavelength levels or bands of exciting radiation of the mercury corresponding to separate excitation frequencies of phosphors to cause them to emit said different spectra of light, the different spectra comprising altered combinations of intensities of spectral lines compared to each other.

2. A lamp as defined in claim 1 wherein said first and second phosphors are blended together.

3. A lamp as defined in claim 1 wherein the first phosphor is excited by the 254 nanometer radiation from mercury and wherein the second phosphor is substantially unexcited by the 254 nanometer radiation, and wherein the second phosphor is excited by the 330 to 440 nanometer radiation from mercury and where the first phosphor is substantially unexcited by the 330 to 440 radiation.

4. A lamp as defined in claim 1 wherein the rare gas has a pressure from below 0.5 torr to above 15 torr.

5. A discharge lamp comprising:

(a) a sealed chamber with at least one transparent wall, (b) a mixture of rare gas and mercury contained within the chamber, (c) a multi-phosphor coating on said transparent wall comprising:

first and second phosphors, said first and second phosphors having different visible emission spectra, (d) means defining two electrodes extending into the chamber through said walls with external electrical contacts, (e) means for driving an electrical signal from one contact through the chamber to the second contact, wherein said electrical signal causes the mercury to emit radiation, and wherein the phosphors absorb said radiation and emit visible light in response thereto, and (f) means for controlling the electrical signal such that the phosphors are preferentially excited such that the phosphors emit said different spectra of visible light responsive to said means for controlling and wherein said means for controlling the electrical signal comprises:

means for providing at least a first and a second setting, wherein said first setting provides a low amplitude continuous wave electrical signal that maintains a low or keep alive level of excitation of said mercury and a corresponding low level of emitted light from said phosphors, and wherein said second setting provides an electrical drive signal that produces a higher amplitude electrical signal and a corresponding higher level of emitted light.

6. A lamp as defined in claim 5 wherein said higher amplitude continuous electrical signal comprises an intermittent signal superimposed on said low amplitude continuous electrical signal.

7. A lamp as defined in claim 5 wherein said higher amplitude continuous electrical signal comprises an intermittent signal with said low amplitude continuous electrical signal occuring between the pulse bursts of said intermittent signal.

8. A discharge lamp comprising:

(a) a sealed chamber with at least one transparent wall, (b) a mixture of rare gas and mercury contained within the chamber, (c) a multi-phosphor coating on said transparent wall comprising:

first and second phosphors, said first and second phosphors having different visible emission spectra, (d) means defining two electrodes extending into the chamber through said walls with external electrical contacts, (e) means for driving an electrical signal from one contact through the chamber to the second contact, wherein said electrical signal causes the mercury to emit radiation, and wherein the phosphors absorb said radiation and emit visible light in response thereto, and (f) means for controlling the electrical signal such that the phosphors are preferentially excited such that the phosphors emit said different spectra of visible light responsive to said means for controlling, and wherein said means for controlling the electrical signal comprises:

means for providing at least a first and a second setting, where said first setting provides a continuous wave electrical signal that causes the mercury to produce substantially all 254 nanometer radiation, and wherein said second setting provides intermittent waveform electrical signals that cause the mercury to produce substantial radiation at and above 330 nanometers and/or below 200 nm in addition to said 254 nm radiation.

9. A lamp as defined in claim 8 wherein said intermittent waveform electrical signals are superimposed on said continuous waveform electrical signal, and where said intermitent waveform electrical signals cause the mercury to produce substantial radiation at and above 330 nanometers in addition to said 254 nm radiation.

10. A lamp as defined in claim 8 wherein the intermittent waveform comprises: means for forming a pulse burst waveform with a duty cycle that extends from less than ten percent to more that ninety percent, and further where individual pulse segments of said pulse burst waveform include a rectangular or square shape.

11. A lamp as defined in claim 10 wherein said individual pulse segments include a triangular shape.

12. A lamp as defined in claim 11 wherein said individual pulse segments include a rounded shape.

13. A discharge lamp comprising:

(a) a sealed chamber with at least one transparent walls, (b) a mixture of rare gas and mercury contained within the chamber, (c) a multi-phosphor coating on said transparent wall comprising:

first and second phosphors, said first and second phosphors having different visible emission spectra, (d) means defining two electrodes extending into the chamber through said walls with external electrical contacts (e) means for driving an electrical signal from one contact through the chamber to the second contact, wherein said electrical signal causes the mercury to emit radiation, and wherein the phosphors absorb said radiation and emit visible light in response thereto, and (f) means for controlling the electrical signal such that the phosphors are preferentially excited such that the phosphors emit said different spectra of visible light responsive to said means for controlling, and wherein the first phosphor is excited by the 254 nanometer radiation from mercury and wherein the second phosphor is substantially unexcited by the 254 nanometer radiation but is excited by radiation below 200 nm or by radiation above 330 nm, or by radiation below 200 nm and above 330 nm.

14. A discharge lamp comprising:

(a) a sealed chamber with transparent wall, (b) a mixture of rare gas and mercury contained within the chamber, (c) a multi-phosphor coating on said wall comprising a plurality of phosphors, (d) means for exciting said mercury to emit radiation, and wherein all said phosphors absorb said radiation and emit visible light in response thereto, (e) means for controlling said means to excite said mercury such that said phosphors preferentially emit a different spectrum of visible light responsive to said means to control, and wherein said means to control the electrical signal comprises:

means for providing at least a first and a second setting, wherein said first setting produces a continuous wave electrical signal that causes the mercury to produce substantially all 254 nanometer radiation, and wherein said second setting produces intermittent waveform electrical signals, that causes the mercury to produce substantial radiation at and above 330 nanometers and/or below 200 nanometers in addition to said 254 nanometer radiation.

15. A lamp as defined in claim 14 wherein the said intermittent waveform elecrical signals is superimposed on said continuous waveform electrical signal, and where said intermitent waveform electrical signals cause the mercury to produce substantial radiation at and above 330 nanometers in addition to said 254 nm radiation.

16. A lamp as defined in claim 14 where at least one of said phosphors comprises a blend of phosphors, and wherein said phosphors overcoat one another forming a plurality of layers, wherein said layers cover chamber wall in a range extending from less than 1 percent to substantially 100 percent of the chamber wall, and wherein at least one of said layers respond to 185 nm radiation, and where at least one of said layers will respond to 365 nm radiation.

17. A lamp as defined in claim 14 wherein there are three layers of phosphors, the first layer responsive to 185 nm radiation, the second layer responsive to 365 nm radiation, and the third layer responsive to 254 nm radiation.

* * * * *